United States Patent [19]

Abbat

[11] Patent Number: 4,609,791

[45] Date of Patent: Sep. 2, 1986

[54] FLEXIBLE DIAPHRAGM KEYPAD AND METHOD OF MANUFACTURE

[75] Inventor: Jean-Pierre Abbat, Raleigh, N.C.

[73] Assignee: ITT Corporation, New York, N.Y.

[21] Appl. No.: 683,892

[22] Filed: Dec. 20, 1984

[51] Int. Cl.[4] ..... H01H 13/14

[52] U.S. Cl. ..... 200/5 A; 29/622; 200/159 B

[58] Field of Search ..... 29/622, 5 A, 159 B

[56] References Cited

U.S. PATENT DOCUMENTS 3,898,421 8/1975 Suzumura ..... 200/5 A 4,272,657 1/1981 Iijima ..... 200/5 A

*Primary Examiner*—A. D. Pellinen

*Assistant Examiner*—Morris Ginsburg

*Attorney, Agent, or Firm*—John T. O'Halloran; Jeffrey P. Morris

[57] ABSTRACT

A keypad is formed of a set of transparent buttons slidably located within apertures of a grid. The grid has sidewalls for engagement with the base of a printed circuit board. Switch assemblies are provided by conductive elastomeric domes formed of a single sheet of elastomeric material disposed between the printed circuit board and the buttons. Integrally formed within a concave side of each dome is a contact region driven by a displacement of a button towards the printed cirucit board. An insulating layer above strip conductors of the circuit board is perforated at sites of the switches to allow the contact region to touch the exposed portions of the conductors to complete an electrical circuit. A dome deforms with springiness which urges the dome back to its original shape upon release of a button by a user of the keypad. Manufacture of the keypad is facilitated by construction of a set of the butons on a webbing which maintains alignment of the buttons as they are secured to the respective domes. The webbing is later removed to permit insertion of the buttons into apertures of the grid.

9 Claims, 9 Drawing Figures

FLEXIBLE DIAPHRAGM KEYPAD AND METHOD OF MANUFACTURE

BACKGROUND OF THE INVENTION

This invention relates to keypads such as are employed in telephones and, more particularly, to a keypad employing a flexible conductive diaphragm disposed between insulating buttons of the keypad and contacts of a printed circuit board.

Keypads, such as telephone keypads, are constructed with twelve keys or push buttons arranged in an array of three columns by four rows. The keypads are manufactured in large numbers and, therefore, a form of construction which permits manufacturing simplicity and economy is desirable. In order to attain this goal, various forms of telephone keypads are currently manufactured. In one form of construction, the buttons press contacts against terminals on a printed circuit board, components of the keypad being manufactured by processes of plastic molding. Other forms of construction include a metal diaphragm over a printed circuit board, and a flexible circuit on plastic film with coined domes. However, these keypads are not as simple and economical to manufacture as would be desirable.

One example of interest in the prior construction of keypads is found in a telephone keypad comprising an insulating elastomeric diaphragm having conductive rubber disks affixed thereto to serve as contacts for connecting terminals on a printed circuit board. Upon advancement of a button being pushed by a user of the telephone, the diaphragm deforms and one of the conductive disks is urged into contact with terminals on the printed circuit board to complete a circuit on the board. However, this form of keypad is disadvantageous in that the manufacturing process requires the emplacement of numerous disks at their respective locations on the insulating diaphragm.

SUMMARY OF THE INVENTION

The foregoing problems are overcome and other advantages are provided by a keypad which is constructed in accordance with the invention so as to permit the use of a more simple and economical procedure of manufacture. The keypad comprises a set of buttons and a plastic plate constructed in the form of a grid with square apertures for positioning the respective buttons. The buttons are transparent so as to acquire their color optically from the grid background. Both the buttons and the grid are electrically insulating. The keypad further comprises a printed circuit board and an electrically conductive elastomeric diaphragm located between the circuit board and the grid. The printed circuit board includes conductors for making electrical connection with circuits such as telephone circuits external to the keypad. The conductors are insulated from the conductive diaphragm except at exposed terminals positioned directly beneath the sites of the respective buttons. The conductive diaphragm is formed with domes at each of the button sites so as to avoid electrical contact with the exposed terminals except upon depression of one of the buttons by a person using the keypad. The foregoing use of the conductive diaphragm with the domes is a significant feature of the invention because this feature simplifies the manufacturing process in that there is no longer any need for the foregoing set of conductive disks.

In accordance with a further feature of the invention, the portion of the conductive diaphragm associated with each dome is molded with a spherical part on the inner surface of the dome for contacting the exposed terminals upon deformation of the diaphragm during a depression of a button. In addition, the spherical portion is formed with extending appendages defining an isohedral and tetrapodic structure of four legs, one of which extends upward to join with a button, while the other three legs serve to position the sphere over the center of the contacting area with the exposed terminals. Alternatively, the appendages may be in the form of six webs which join in intersections defined by the foregoing set of four legs. The latter alternative is advantageous in facilitating the molding process by which the diaphragm is constructed. The webs and legs are resilient, and extend beyond tangential planes of the sphere so as to lift the sphere above the exposed terminals of the cirucit board except when a button is depressed. A savings in material can be accomplished by constructing the diaphragm as a trellis.

The foregoing keypad is constructed in accordance with a method of the invention wherein the buttons are formed on a continuous strip of plastic webbing, the diaphragm including the domes are constructed as a unitary assembly by liquid injection molding of a conductive elastomer which is bonded to the buttons on the webbing of buttons, after which the webbing is separated from the buttons by a punch press. The assembly is completed by locating the diaphragm on the circuit board by conventional techniques, and by positioning the grid on the buttons.

BRIEF DESCRIPTION OF THE DRAWING

The foregoing features and other aspects of the invention are explained in the following description taken in connection with the accompanying drawing wherein.

DETAILED DESCRIPTION

Figure 1:
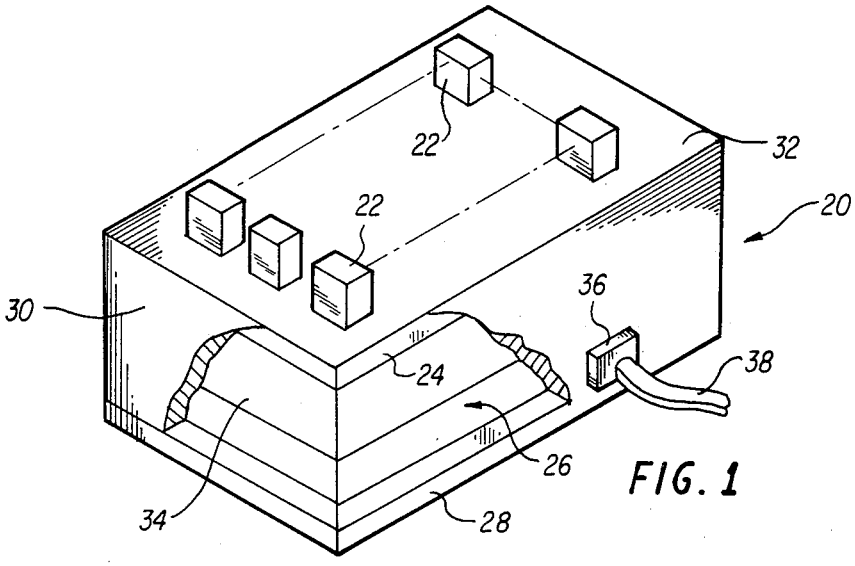
FIG. 1 is a stylized isometric view, partially cutaway, of a keypad constructed in accordance with the invention.

In FIG. 1, there is presented a stylized view of a keypad 20 constructed in accordance with the invention. The keypad 20 comprises an array of keys or push buttons 22 located within a face plate constructed as a grid 24. The keypad 20 further comprises a printed circuit board 26 having a base 28. The grid 24 is provided with sidewalls 30 which extend downwardly from the peripheral edges of a face 32 of the grid 24 to set upon the base 28. A flexible diaphragm 34 is located between the grid 24 and the circuit board 26. A connector 36 (FIG. 1) is provided on the circuit board 26 for coupling an electrical cable 38 to circuitry on the board 26.

Figure 2:
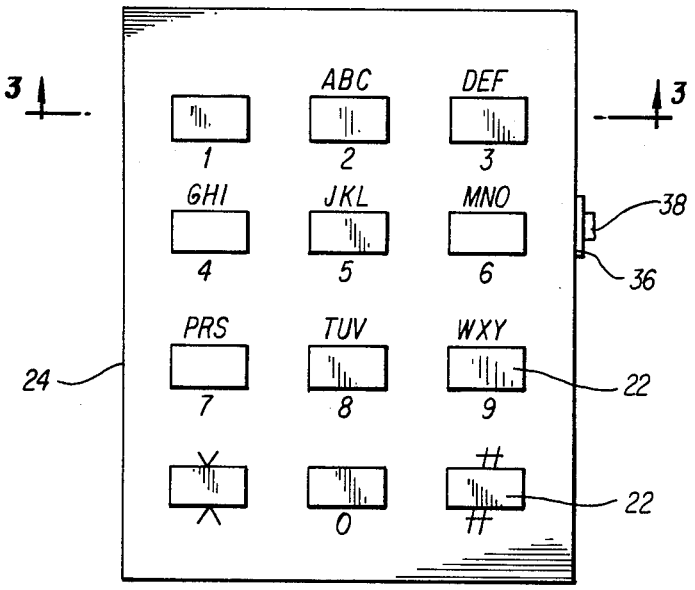
FIG. 2 is a plan view of the keypad of FIG. 1.

As shown in the plan view of FIG. 2, the face 32 of the grid 24 has a dark coating, and the legends identifying the buttons 22 are of a light color. The buttons 22 are fabricated of a transparent plastic material so as to receive the color of the grid 24 which serves as the background to the array of buttons 22. In accordance with a feature of the invention, the buttons 22 do not have any legends on them, the legends being located only on the grid 24. Such an arrangement permits the buttons to be used in keypads for many different functions while only the nomenclature on the grid 24 need be changed to accommodate the various functions. In the example of FIG. 2, the legends are those presented on a telephone dial assembly.

Figure 3:
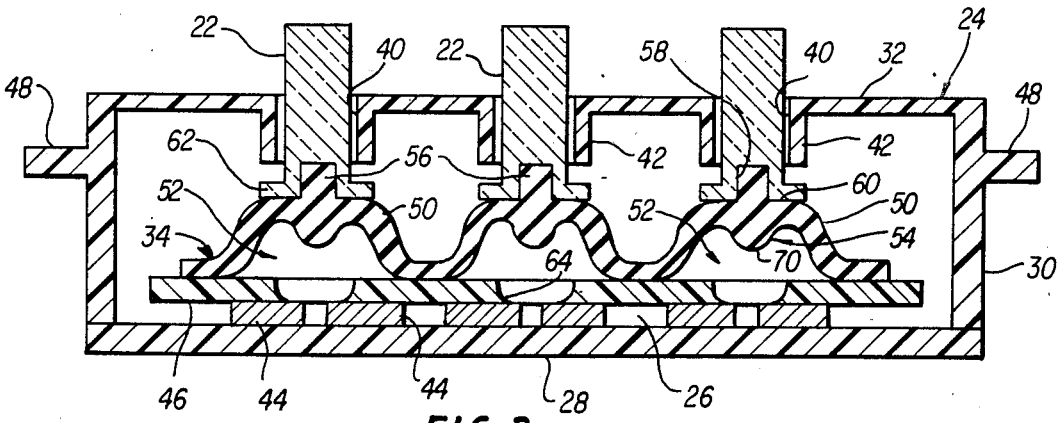
FIG. 3 is a sectional view of the keypad taken along the line 3—3 in FIG. 2 including switch contact regions disposed beneath domes of a diaphragm.

With reference also to FIG. 3, there are shown details in the construction of the keypad 20, in accordance with the invention, so as to enable the fabrication of the keypad 20 by a simplified and more economical manufacturing process. The keypad 20 may be provided with any number of buttons 22 in any desired configuration, depending on the function to be provided by the keypad 20. The most common arrangement is that utilized in a telephone dial assembly, such as that depicted in FIGS. 1 and 2 wherein twelve buttons are arranged in an array of three columns and four rows. The grid 24 is provided with a set of twelve apertures 40, individual ones of the buttons 22 being located within corresponding ones of the apertures 40. Each button 22 has a rectangular cross section wherein the length is twice the width. The apertures 40 have a corresponding shape. At the site of each aperture 40, the grid 24 is provided with an integrally formed skirt 42 which surrounds a button 22. The aperture 40 extends from the face 32 of the grid 24 through the entire length of the skirt 42, and is slightly larger than the cross section of a button 22 so as to allow the button 22 to slide freely through the skirt 42. The skirt 42 serves to position the button 22 and to guide the button 22 during a translation of the button 22 upon depression by a user of the keypad 20.

An additional function of the skirt 42 concerns the coloration of the button 22. Due to the transparency of the button 22, ambient light entering the button 22 reflects against the interior surface of the skirt 42 and imparts the color of the skirt 42 to the button 22. Thereby, in the manufacture of the keypad 20, one set of buttons 22 can be used with keypads 20 of differing colors since the buttons 22 adopt the color of the grid 24. Also, in view of the above-noted lack of any indicia on the buttons 22, the manufacturing process is simplified in that all the buttons 22 may be made identically to avoid the steps of sorting and collation which would otherwise be required in the manufacturing process.

The circuit board 26 further comprises a set of metal strip conductors 44 which are deposited by coventional techniques on the base 28 of the circuit board 26. The conductors 44 are covered with a layer 46 of electrical insulation, the layer 46 being fabricated of an elastomar such as silicone rubber or urethane. The ends of the base 28 extend beyond the region of the conductors 44 and the insulating layer 46 for contacting the sidewalls 30 of the grid 24, thereby to complete an exterior box which houses the keypad 20. Tangs 48 may be provided on the sidewalls 30 for securing the keypad 20 to a larger assembly (not shown) such as a telephone hand set.

The diaphragm 34, which is indicated only in a simplified format in FIG. 1, comprises a sheet of electrically insulating elastomer material having a set of raised portions, or domes 50, at sites corresponding to the locations of the buttons 22 as is depicted in the detailed view of FIG. 3. While the diaphragm 34 may be fabricated of a silicone rubber polymer by a process of liquid injection molding, the preferred construction of the diaphragm 34 is that of a urethane elastomer by the process of injection molding. The latter material is preferred because it reduces the cost of the manufacturing process. With either the silicone or the urethane material, the material is either coated or impregnated with a metal or carbon so as to provide electrical conductivity to the diaphragm 34. Thereby, the diaphragm 34 in combination with the array of electrical conductors 44 form a set of contacts for electrical switches 52 which are operated by corresponding ones of the buttons 22.

In operation, each dome 50 is provided with an interior electrical contact 54 which has a substantially spherical shape, is integrally formed with the diaphragm 34, and depends downward from the center of a dome 50. Above each contact 54, and integrally formed with the diaphragm 34, there is a leg 56 which extends upwardly for engagement in a cavity 58 in the bottom of a button 22. The top of the exterior surface of each dome 50 has a flattened region in the form of a step 60 for engagement with a bottom lip 62 of a button 22. The configuration of the step 60 and the leg 58 provide for secure engagement with a button 22 for positively orienting a dome 50 with the axis of a button 22. The button 22 is permanently affixed to the corresponding dome 50 by a bonding process which takes place during assembly of the keypad 20 wherein the buttons 22 are brought into contact with their respective domes 50 prior to the curing of the elastomer material of the diaphragm 34. During the hot-temperature curing of the elastomer, the plastic material of the button 22 bonds to the diaphragm 34.

The material of the diaphragm 34 is flexible and, upon a depression of a button 22, the corresponding dome 50 deforms to allow the contact 54 to advance towards a pair of conductors 44 of the corresponding switch 52. Within the region of a switch 52, the insulating layer 46 has been deleted to form a cavity 64 which exposes portions of the conductors 44 for engagement with the contact 54 as the contact 54 advances during the pressing of the corresponding button 22. Within a switch 52, as the contact 54 presses against portions of the adjacent spaced-apart conductors 44, electrical connection is made between the two conductors 44 via the contact 54. This constitutes a closing of the switch 52. Upon release of the pushbutton 22, the inherent springiness of the diaphragm 34 causes the dome 50 to resume its original shape along with a retraction of the button 22 to its rest position. By this operation, each switch 52 is activated by the corresponding button 22 to provide a closure and an opening of an electrical circuit coupled via the conductors 44 to the switch 52. In the case of the array of twelve buttons 22 depicted in FIGS. 1 and 2, the conductors 44 of the corresponding twelve switches 52 are connected via the cable 38 to an external circuit (not shown) distant from the keypad 20. In FIG. 3, the buttons 22 are shown partially depressed from their rest positions. At each switch 52, the lip 62 of a button 22 abuts against the lower edge of the skirt 42 to retain the button 22 in its rest position against the spring force in the dome 50 of the diaphragm 34. The arrangement of the lip 62 and the skirt 42 maintains the desired attitude of the dome 50 when the button 22 is in its rest position.

Figure 7:
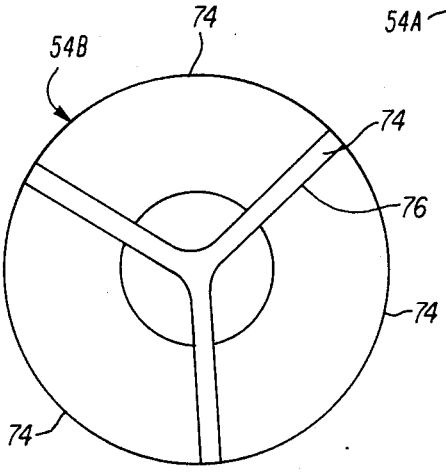
FIG. 7 is a plan view of the web structure of FIG. 6.

In view of the deformation experienced by a dome 50 during activation of a switch 52, it is advantageous to construct the region of the electrical contact 54 with a configuration that assures self-alignment of the contact 54 with the central region of the corresponding cavity 64 in the insulating layer 46, thereby to insure proper mating of the surface of the contact 54 with the exposed regions of the electrical conductors 44. One such modification of the contact 54 is shown in FIGS. 4 and 5, and a second suitable modification of the contact 54 is shown in FIGS. 6 and 7.

Figure 4:
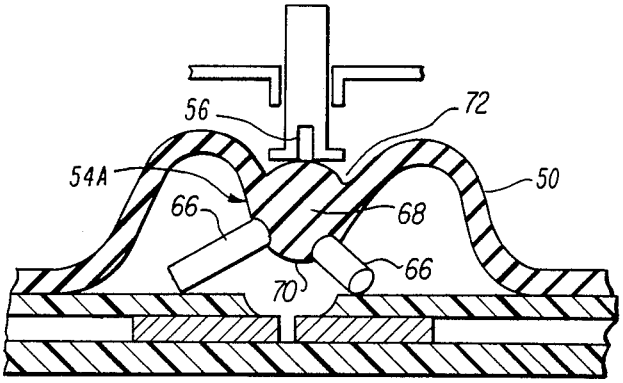
FIG. 4 is an enlarged side view of a contact region of a dome in the diaphragm of FIG. 1 showing details of a first embodiment of a tetrahedral arrangement of a stabilizing and positioning structure comprising a set of leg-shaped appendages which may be incorporated at a contact region of FIG. 3.
Figure 5:
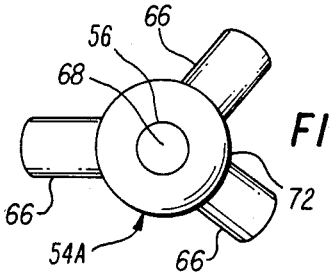
FIG. 5 is a plan view of the contact region of FIG. 4.
Figure 6:
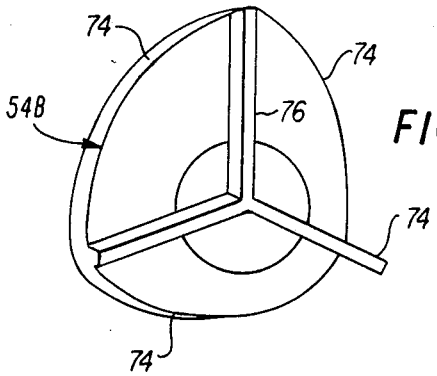
FIG. 6 is a side view of an alternative embodiment of the stabilizing and positioning structure of FIG. 4 constructed as a set of webs.

With reference to FIGS. 4 and 5, there is shown an alternative embodiment of electrical contact 54A wherein the central portion of the dome 50 has been molded with appendages in the form of legs distributed about a central point 68 with isohedral symmetry such that the legs 66 extend towards the vertices of a tetrahedron. Three of the legs 66 extend in a generally downward direction, the outer ends of the legs 66 defining a plane (not shown) which is normal to a radius extending from the central point 68 but which is spaced apart from tangency with the contacting surface 70 of the contact 54A. The fourth leg of the tetrahedral arrangement is the aforementioned leg 56 which extends upwardly to a button 22. The four legs are directed outwardly from a central sphere 72 centered about the point 68 with spherical symmetry of the arrangement of the four legs. The surface 70 forms a part of the sphere 72, the surface 70 then departing from the spherical surface to continue on into the underside of a dome 50.

The legs 66 are flexible so as to deform upon depression of a button 22 for closing a switch 52. The deformation of the legs 66 occurs upon a contacting of the legs 66 with the insulating layer 46, and permits the surface 70 to contact the exposed regions of the conductors 44.

The operation of the legs 66 is much like that of a tripod for stabilizing and orienting the contact 54A as it begins to abut the bottom of a cavity 64 during advancement of a button 22. In the event that the contact 54A were to deflect slightly off the axis of the button 22 because of deformation of the dome 50, one or two of the legs 66 would contact the bottom of the cavity 64 prior to the arrival of the third of the legs 66 to apply a restoring torque to the contact 54A and urge the contact 54A back into alignment with the button axis. Thereby, the arrangement of the three legs 66 provides the additional inventive feature of orienting and stabilizing the contact 54A as it is brought into abutment with the conductors 44.

FIG. 4 shows the extension of the legs 66 as the contact 54 approaches the bottom of a cavity 64, but before the contact 54A has advanced downwardly a sufficient amount to deform the legs 66 for allowing the surface 70 to abut the conductors 44. FIG. 5 shows a top plan view of the portion of a dome 50 having the contact 54A, the legs 66 being shown extending outward from beneath the dome 50 while the leg 56 extends upward from the dome 50.

With reference to FIGS. 6 and 7, there are shown side and plan views of a further embodiment of electrical contact 54B. The views in FIGS. 6 and 7 correspond to those of FIGS. 4 and 5, except that in FIG. 7, the view has been simplified by deletion of the structure of the dome 50, the view showing only the portions of a contact 54B having the isohedral symmetry. The contact 54B is attained by modifying the contact 54A by the inclusion of webs 74 positioned between the legs and lying in planes which pass through the center point 68. The outer edges of the webs 74 are arcs of a circle centered at the point 68. The legs 66 of FIGS. 4 and 5 are replaced by intersections at 76 in FIGS. 6 and 7 formed with individual ones of the webs 74 lying in different planes. In the operation of the contacts 54B, the peripheral regions of the webs 74 contact the bottom portion of a cavity 64 in the insulating layer 46 upon advancement of a button 22. The webs 74 then orient and direct the contact 54B upon closure of a switch 52 to insure a proper abutment of the contact surface 70 with the exposed regions of the conductors 44. Thereby, both the electrical contacts 54A and 54B serve to stabilize the operation of a switch 52 against any uneven deformation in a dome 50.

Figure 8:
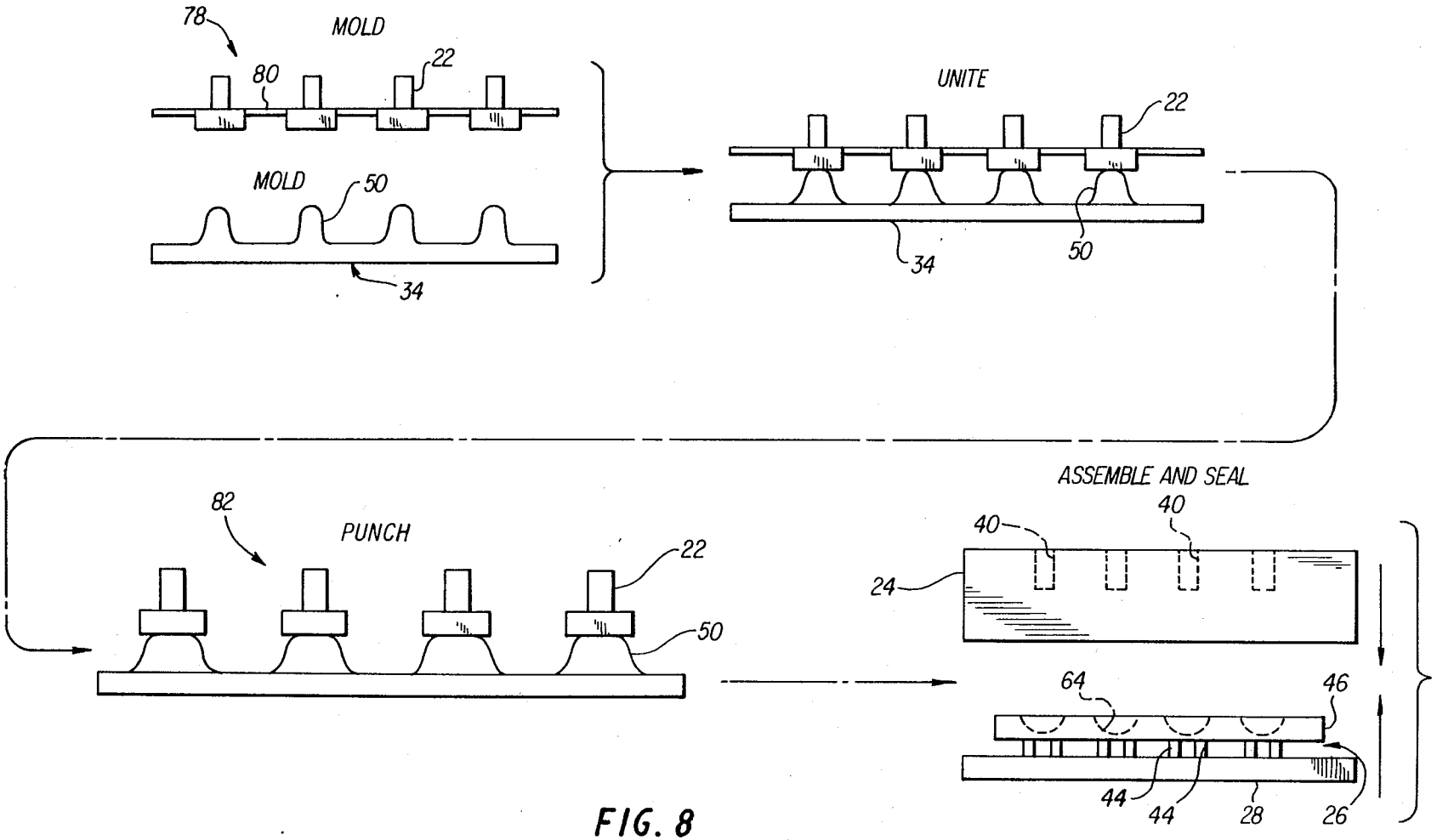
FIG. 8 is a diagram of a method of contruction of the keypad in accordance with the invention.

FIG. 8 outlines a manufacturing process of the invention for producing the keypad 20 with improved efficiency, both in terms of the number of operational steps and in terms of cost. First, an assembly 78 of buttons 22 connected by webbing 80 is molded, as by injection molding. Also, the diaphragm 34 with the array of domes 50 therein is molded as a unitary assembly, as by the process of injection molding. A urethane elastomer combined with material to provide electrical conductivity is preferred in the construction of the diaphragm 34. Such construction provides for springiness, electrical conductivity, and the capacity to be deformed and returned to the original shape. The molded assembly 78 of buttons 22 and the diaphragm 34 are then united with the top portions of the domes 50 in contact with the bottom portions of the buttons 22 prior to the curing of polymerization of the elastomer in the diaphragm 34. The step of uniting takes place in a heated chamber to accelerate the polymerization while the material of the diaphragm 34 is in contact with the buttons 22. Thereby, upon the curing of the elastomer, the domes 50 adhere to the buttons 22.

The manufacturing process continues with a following step of punching, as by means of a punch press, the webbing 80 which joins the buttons 22. The punching step frees the buttons 22 from the webbing 80 so as to provide a unit 82 comprising individual assemblies of buttons and dome. Finally, the unit 82 is placed between a grid 24 and a circuit board 26 which are then closed upon the unit 82. The grid 24 and the base 28 of the circuit board 26 may be secured to each other by heat staking to seal the finished assembly of the keypad 20.

Figure 9:
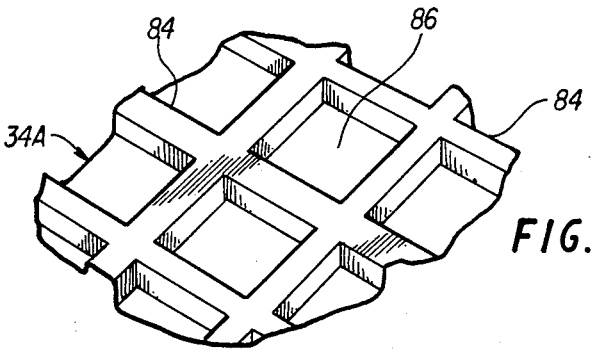
FIG. 9 is a fragmentary view of an alternative embodiment of a diaphragm of FIG. 1 having a lattice construction.

By way of alternative embodiments, it is noted that the diaphragm 34 may be molded to have the form of a trellis, or lattice, as is disclosed in FIG. 9, which replaces the uniformly thick layer of material except for the region of a sphere 72. As shown in FIG. 9, a diaphragm 34A is molded with ribs 84 defining voids 86 which introduce a substantial saving in material, while the ribs 84 maintain structural rigidity to the diaphragm 34A. The lattice form is advantageous in view of the substantial amount of the elastomer material which is deleted from the diaphragm 34. Such a savings in material reduces the cost of manufacture. With either embodiment of the diaphragm 34, the thermosetting polyurethane elastomer is employed to provide the requisite resiliency for use in the operation of the switches 52. The material of the lattice form of diaphragm is also electrically conducting as is the case with the diaphragm 34 formed of the uniformly thick sheet of elastomer.

Thus, the invention has provided a form of keypad wherein the same components can be utilized in the construction keypads intended for different functions. Only the face of the grid need be altered to provide suitable labeling for the specific function for which the keypad is intended. The construction of the keypad permits the buttons to be molded initially as a set of buttons joined by webbing in a unitary assembly which permits simultaneous connection of all the buttons to all the domes in a single step of the manufacturing process. Upon removal of the webbing, as by a punch press, the set of buttons is then inserted into the set of apertures of the grid. The circuit board is readily fabricated by conventional techniques and, the insulating layer is readily perforated for exposure of the strip conductors at the site of each switch. The assembly of the keypad is completed readily by placing the circuit board behing the diaphragm and securing the circuit board to the sidewalls of the grid. Thereby, the invention has provided a keypad which is readily manufactured.

The composite element of tetrapodic structure and contact region can be employed in yet a further embodiment of the keypad wherein each such composite element is held in position by a web in lieu of the diaphragm. During a manufacturing process, each composite element is separately formed and is inserted within one of a set of slightly undersized star-shaped apertures in the web which traps the three bottom legs and the contact region beneath the web for engagement with the strip conductors. The fourth leg of each composite element extends upwardly for insertion into a button. Thereby, the composite element may be employed universally in the construction of keypads.

It is to be understood that the above described embodiments of the invention are illustrative only, and that modifications thereof may occur to those skilled in the art. Accordingly, this invention is not to be regarded as limited to the embodiments disclosed herein, but is to be limited only as defined by the appended claims.

What is claimed is:

1. A keypad comprising:

an array of buttons;

a grid having apertures for locating said buttons;

a conductive elastomeric diaphragm disposed beneath said grid and connecting with each of said buttons;

a circuit board disposed on a side of said diaphragm opposite said grid;

an insulating layer positioned between said circuit board and said diaphragm, said insulating layer having cavities at locations beneath sites of said buttons, said circuit board having a set of electrical conductors which are insulated except at locations beneath sites of said buttons wherein said conductors are exposed partially by said cavities to form terminals; and wherein said diaphragm comprises a set of domes opening towards said terminals, there being one dome for each of said buttons, the top of each dome facing a corresponding one of said buttons, each dome having a substantially spherically shaped contact region for closing an electrical circuit between terminals of said board upon compression of the dome by a displacement of the corresponding button, each cavity being formed for receiving a corresponding spherically shaped contact region.

2. A keypad comprising:

an array of buttons;

a grid having apertures for locating said buttons;

a conductive elastomeric diaphragm disposed beneath said grid and connecting with each of said buttons;

a circuit board disposed on a side of said diaphragm opposite said grid, said circuit board having a set of electrical conductors which are insulated except at locations beneath sites of said buttons wherein said conductors are exposed to form terminals; and wherein said diaphragm comprises a set of domes opening towards said terminals, there being one dome for each of said buttons, the top of each dome facing a corresponding one of said buttons, each dome having a substantially spherically shaped contact region for closing an electrical circuit between terminals of said board upon compression of the dome by a displacement of the corresponding button; and wherein said contact region includes a set of appendages positioned with tetrahedral symmetry for locating said contact region upon terminals of said circuit board.

3. The keypad according to claim 2 wherein said set of appendages is a set of legs extending to a plane spaced apart from a substantially spherical surface of said contact region.

4. A keypad according to claim 2 wherein said set of appendages comprises a set of webs disposed in planes intersecting a central point of said contact region, and wherein peripheral edges of said webs are formed as circular arcs about said central point.

5. A keypad according to claim 2 wherein said grid further comprises a set of inwardly depending skirts located at the sites of respective ones of said apertures for guiding respective ones of said buttons during displacements of respective ones of said buttons.

6. A keypad according to claim 5 wherein said buttons are transparent to permit light incident upon said buttons to reflect off said skirts to provide a coloration to said buttons equal to the coloration of said skirts.

7. A keypad according to claim 6 wherein said domes connect with said buttons to provide for a linear displacement of said contact region upon displacement of a pushbutton, each of said domes resiliently yielding to pressure of the corresponding one of said buttons to allow the contact region to come into abutment with terminals of said circuit board, the material of said diaphragm having springiness to restore individual ones of said domes to an upright position upon release of a button by a user of the keypad.

8. A keypad according to claim 7 wherein said diaphragm incorporates a lattice structure.

9. A keypad comprising:

an array of buttons;

a grid having apertures for locating said buttons;

a conductive elastomeric diaphragm disposed beneath said grid and connecting with each of said buttons;

a circuit board disposed on a side of said diaphragm opposite said grid, said circuit board having a set of electrical conductors which are insulated except at locations beneath sites of said buttons wherein said conductors are exposed to form terminals; and wherein said diaphragm comprises a set of domes opening towards said terminals, there being one dome for each of said buttons, the top of each dome facing a corresponding one of said buttons, each dome having a substantially spherically shaped contact region for closing an electrical circuit between terminals of said board upon compression of the dome by a displacement of the corresponding button; and wherein said diaphragm incorporates a lattice structure.

* * * * *